US009528255B2

(12) United States Patent
Zhang et al.

(10) Patent No.: US 9,528,255 B2
(45) Date of Patent: Dec. 27, 2016

(54) NOZZLE DEVICE AND A TOILET WITH THE NOZZLE DEVICE

(71) Applicant: Shanghai Kohler Electronics LTD., Shanghai (CN)

(72) Inventors: Xuewen Zhang, Shanghai (CN); Fei Shen, Shanghai (CN); Jun Lu, Shanghai (CN); Huayun Zhu, Shanghai (CN)

(73) Assignee: SHANGHAI KOHLER ELECTRONICS, LTD., Shanghai (CN)

( * ) Notice: Subject to any disclaimer, the term of this patent is extended or adjusted under 35 U.S.C. 154(b) by 439 days.

(21) Appl. No.: 14/092,482

(22) Filed: Nov. 27, 2013

(65) Prior Publication Data

US 2014/0143946 A1 May 29, 2014

(30) Foreign Application Priority Data

Nov. 29, 2012 (CN) ..... 2012 1 0500654

(51) Int. Cl.
*E03D 9/08* (2006.01)

(52) U.S. Cl.
CPC ..... *E03D 9/08* (2013.01)

(58) Field of Classification Search
CPC ..... E03D 9/08
USPC ..... 4/420.4, 444, 447, 448
See application file for complete search history.

(56) References Cited

U.S. PATENT DOCUMENTS

| | | | | |
|---|---|---|---|---|
| 3,570,015 A * | 3/1971 | Rosengaus | E03D 9/085 | 4/420.4 |
| 4,094,018 A * | 6/1978 | Bemthin | E03D 9/08 | 4/420.4 |
| 2012/0174309 A1* | 7/2012 | Kuang | E03D 9/08 | 4/420.4 |

* cited by examiner

*Primary Examiner* — Tuan N Nguyen
(74) *Attorney, Agent, or Firm* — Foley & Lardner LLP

(57) ABSTRACT

An effuser for a plumbing apparatus including a stepper motor, a transmission mechanism connected with an output end of the stepper motor, an effuser connected with the transmission mechanism and configured to spray water from an internal water pipe using a nozzle, wherein the transmission mechanism extends and retracts the effuser by rotating the effuser about an axis transverse to the plumbing apparatus when driven by the stepper motor.

25 Claims, 6 Drawing Sheets

NOZZLE DEVICE AND A TOILET WITH THE NOZZLE DEVICE

CROSS-REFERENCE TO RELATED PATENT APPLICATIONS

This application claims the benefit of and priority to Chinese P.R. Priority Application No. 201210500654.1, filed Nov. 29, 2012, which is incorporated herein by reference in its entirety.

BACKGROUND OF THE INVENTION

As shown in FIG. 1, a pedestal pan of the prior art includes a cover board 1' and a seat ring 2', wherein an effuser 4' thereof is mounted on a toilet seat body 3'. When in use, the effuser 4' protrudes from the toilet seat body 3' to partially clean a local region of the human body (for example, genitals and anal region). The effuser 4' is arranged on the toilet seat body 3' such that the thickness of the pedestal pan is increased. The effuser 4' sprays water at an angle such that the genitals of a user of the device are easily contaminated when the anus is cleaned. FIG. 2 shows another effuser device of the prior art mounted in another way. Effusers 4' are generally arranged at both sides of a toilet seat body 3' with one effuser 4' arranged at each side. When used, the effusers at both sides protrude to spray water. The water partially cleans a local region of the human body (for example, genitals and anal region). When not in use, the effusers 4' return to an initial position. In this case, effusers 4' need to be arranged at both sides which is a complex structure and results in a cumbersome assembly procedure. Due to the shorter length of the effusers 4' at each side, the effusers 4' need to spray water from the side at an angle to partially clean the human body. This results in a local region of the human body that cannot be accurately cleaned. Additionally, clean water is wasted. With effusers 4' mounted on the toilet seat body 3' and configured to protrude at a downward angle, the overall size of a pedestal pan device is increased.

SUMMARY OF THE INVENTION

According to one embodiment, an objective of the present invention is to overcome the defects of the prior art. The effuser device is simple in structure, small in overall size and comfortable to use. In some embodiments, the device may be a pedestal pan with an effuser device.

An embodiment of the present invention includes an effuser device with a base, a stepper motor mounted on the base, a transmission mechanism mounted on the base and connected with an output end of the stepper motor, and an effuser connected with the transmission mechanism, wherein the effuser is internally provided with a water pipe and provided with a nozzle for spraying water from the water pipe, and wherein the transmission mechanism can drive the effuser to extend or retract in an overturn manner from a lower part of the base when driven by the stepper motor.

Another embodiment of the present invention provides a pedestal pan with a cover board, a seat ring, and an effuser device mounted in the seat ring, wherein the effuser device includes a base fixed below the seat ring, a stepper motor mounted on the base, a transmission mechanism mounted on the base and connected with an output end of the stepper motor, and an effuser connected with the transmission mechanism, wherein the effuser is internally provided with a water pipe and provided with a nozzle for spraying water from the water pipe, and the transmission mechanism can drive the effuser to extend or retract fanwise from a lower part of the base when driven by the stepper motor.

Some embodiments of the present invention may have the following benefits. An effuser device of the present invention only needs one effuser with simple mounting. The length of the effuser is longer than that of an effuser of an ordinary pedestal pan device so that more water pipes and nozzles may be provided and/or arranged in different configurations. The nozzle is positioned on a central axis, along the width direction of the seat ring, so that spraying water at an angle is unnecessary. This in turn results in saving water resources and a more comfortable cleaning experience for users. According to one embodiment of the present invention, the effuser device and the waterway dispenser are moved into the seat ring to make more space for equipping a pedestal pan device with other components. Moving the effuser device and the waterway dispenser into the seat ring results in a pedestal pan device with a small thickness and a compact structure. According to one embodiment of the invention, a control unit is arranged on the cover board in a distributed control manner thereby reducing internal line arrangement and saving space.

DETAILED DESCRIPTION OF THE PREFERRED EMBODIMENTS

Specific embodiments of the present invention will be further described below with reference to the accompanying drawings.

Figure 1:
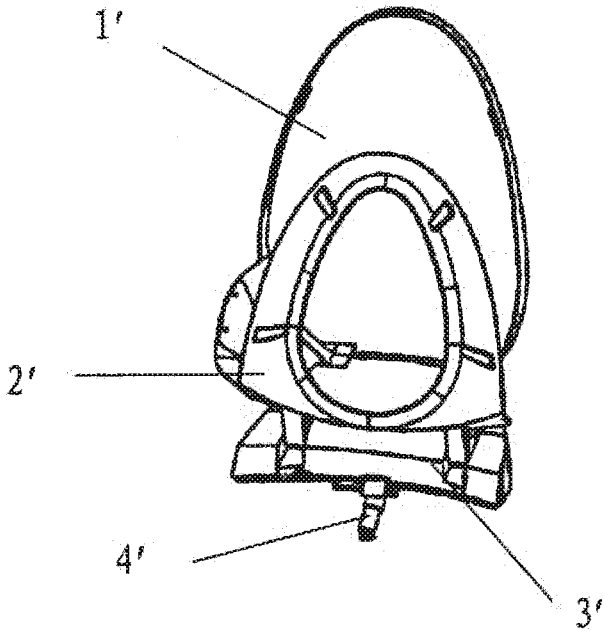
FIG. 1 (Prior Art)
FIG. 1 is an illustration of a prior art effuser mounted on a pedestal pan.
Figure 2:
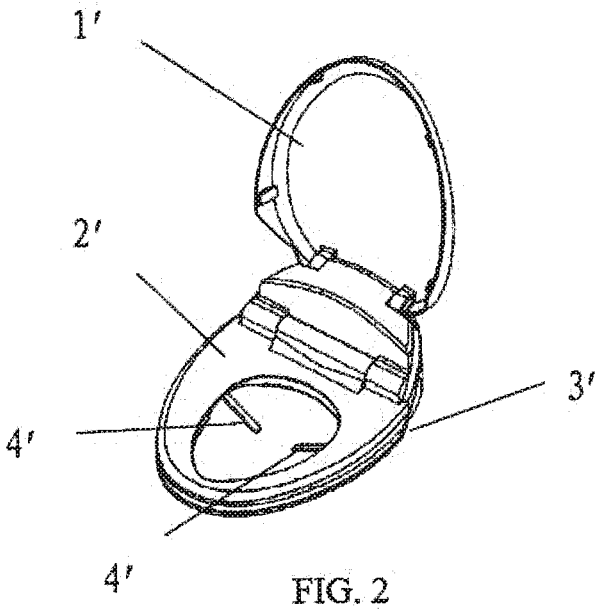
FIG. 2 (Prior Art)
FIG. 2 is an illustration of prior art effusers mounted on both sides of a pedestal pan.
Figure 3:
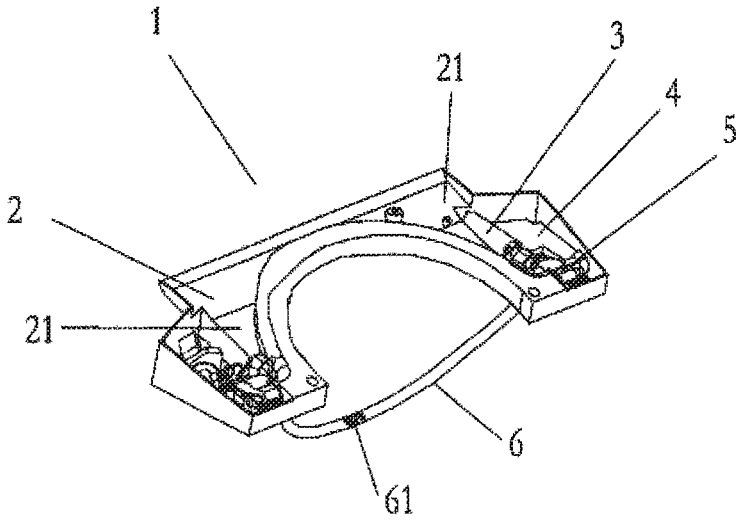
FIG. 3 is an illustration of an effuser device according to one embodiment of the invention.
Figure 4:
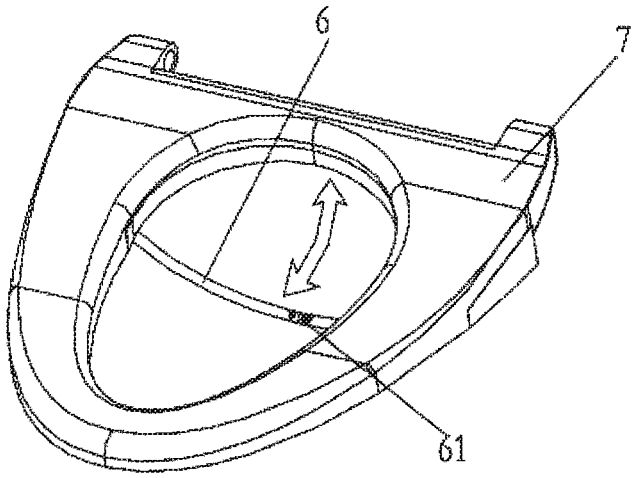
FIG. 4 is an illustration of one embodiment of the invention showing an effuser device mounted on a seat ring.

FIG. 3 illustrates an effuser device 1 according to one embodiment of the present invention. The effuser device includes a base 2, a stepper motor 3, a transmission mechanism 5 and an effuser 6. The stepper motor 3 is mounted on the base 2. The transmission mechanism 5 is also mounted on the base 2. The transmission mechanism 5 is connected with an output end of the stepper motor 3. The effuser 6 is connected with the transmission mechanism 5. The effuser 6 includes an internal water pipe (not shown). The effuser 6 includes a nozzle 61 to spray water from the water pipe. The transmission mechanism 5 drives the effuser 6 to extend or retract in an overturn manner from a lower part of the base 2 when driven by the stepper motor 3. The overturn manner (e.g. the effuser rotates about an axis transverse to a plumbing apparatus; rotates about an axis extending across, left to right, a basin of a plumbing apparatus; rotates about an axis transverse to a plumbing apparatus where the axis is perpendicular to a line extending from the basin of the apparatus to the tank of the apparatus; rotates about an axis parallel to an axis formed by the output end of one or more transmission mechanisms; rotates about an axis defined by an effuser support such as a bracket, bearing, channel, opening, etc.; or rotates about an axis parallel to the width of the apparatus) is illustrated in FIG. 4 by the arrow shown therein.

With reference to FIGS. 3-7, a base mounting portion 21 is arranged on the upper face of the base 2. The stepper motor 3, a drive circuit board 4 and the transmission mechanism 5 are all arranged in the base mounting portion 21. The drive circuit board 4, is also mounted on the base 2. The drive circuit board 4 is connected with the stepper motor 3 via a conducting wire. A main control unit on a pedestal pan is used for controlling the operation of the stepper motor 3 by the drive circuit board 4. The drive circuit board 4 provides a signal to the stepper motor 3 to control its forward and reverse rotation, thereby controlling the effuser 6 to extend and retract in an overturn manner from the lower part of the base 2.

The effuser 6 is arranged on one face of base 2 opposite to the base mounting portion 21. An end of effuser 6 is connected with an output end of the transmission mechanism 5 which drives the effuser 6 through rotation. Particularly, the stepper motor 3 transmits torque to the transmission mechanism 5 which then drives the effuser 6 to extend fanwise in an overturn manner from the lower part of the base 2. This is shown by the arrow of FIG. 4. The effuser 6 rotates about the connection with the transmission mechanism 5 in the shape of an arc from the lower part of the base 2. The effuser 6 is configured extend from below a seat ring 7 to a position under the user. When a user presses a button, clean water will flow into the water pipe in effuser 6 and then will be sprayed out from the nozzle 61. The water sprayed from nozzle 61 cleans a local part of the human body.

Figure 6:
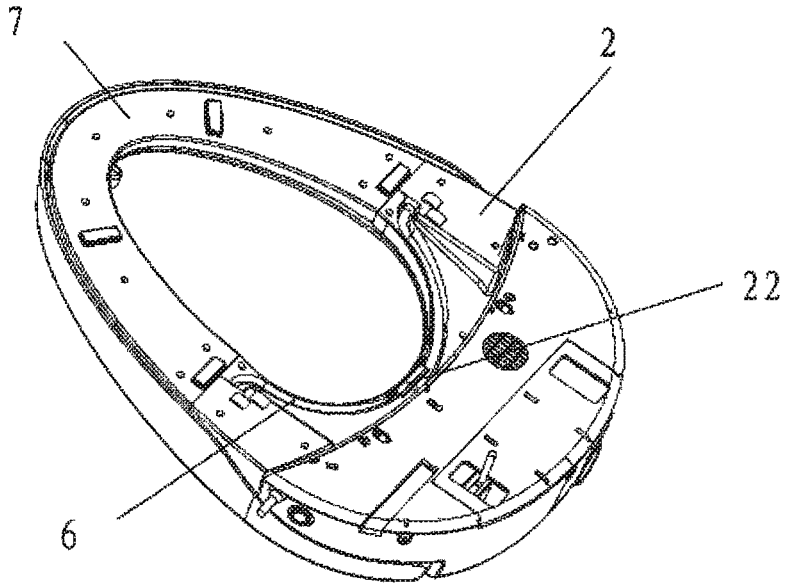
FIG. 6 is an illustration of one embodiment of the invention showing a retracted effuser.
Figure 7:
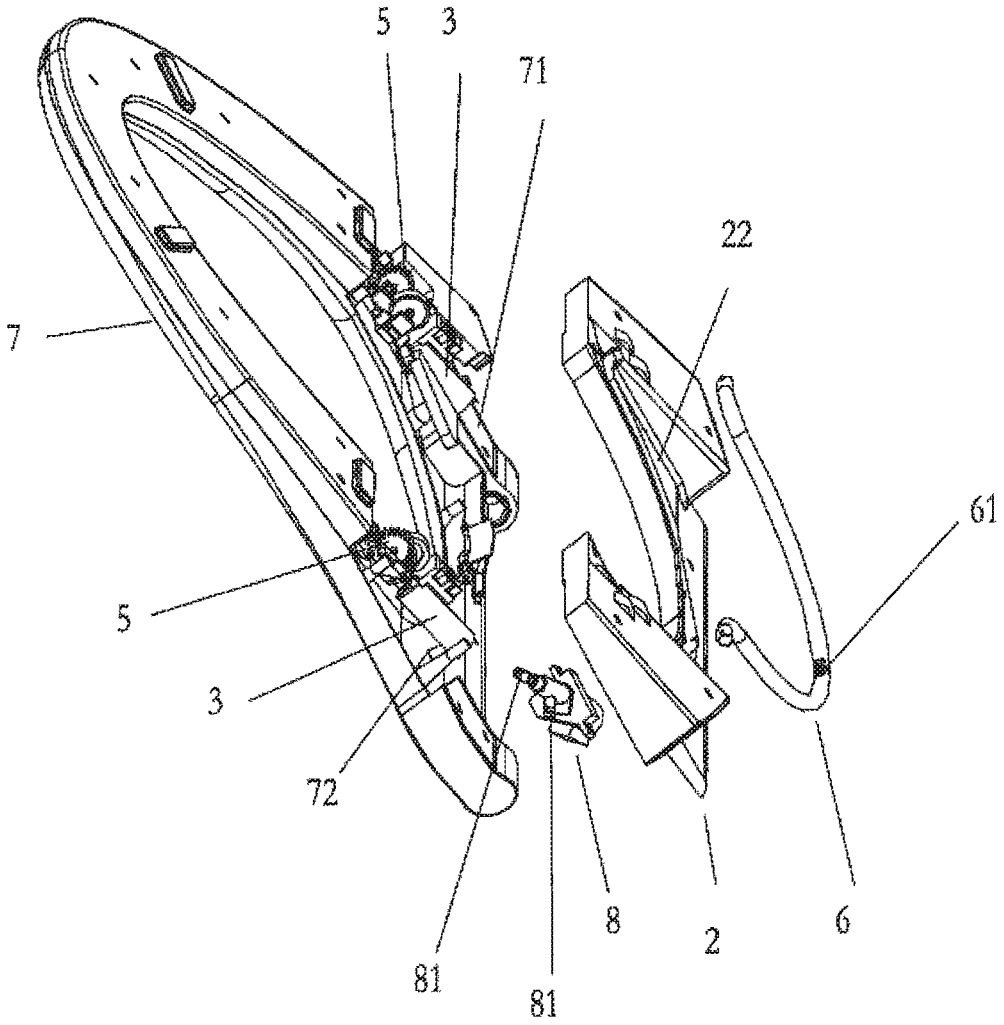
FIG. 7 is illustration of one embodiment of the invention showing an effuser device seat ring, and waterway dispenser.

In some preferred embodiments of the invention, an effuser resetting groove 22 for receiving the effuser 6 in a retracted state is arranged below the base 2 as shown in FIGS. 6-7. When driven by the transmission mechanism 5 to retract fanwise in an overturn manner, the effuser 6 retracts into the effuser resetting groove 22.

As shown in FIGS. 3-7, the effuser 6 may be an arc-shaped effuser in some embodiments. In order to better match seat ring 7 and base 2, the radius of effuser 6 may be adjusted to fit the radius of seat ring 7 and/or the radius of base 2. In some preferred embodiments, the nozzle 61 may be positioned on a central axis of the effuser 6. A plurality of nozzles 61 or different kinds of various nozzles 61 may be arranged on the effuser 6. Different spray cleaning effects may be generated with alternative nozzle configurations. Alternative configurations may improve comfort for the user. As illustrated, nozzle 61 may be located at the inflection point of the arc of effuser 6.

As shown in FIG. 7, the base 2 is also provided with a waterway dispenser 8. The waterway dispenser 8 may include a plurality of dispensing ports 81. The effuser 6 includes one or more internal water pipes (not shown). The water pipes are connected with corresponding dispensing ports 81 on the waterway dispenser 8. The waterway dispenser 8 is mounted on the base mounting portion 21 of the base 2 and fixed in a waterway dispenser mounting space of the seat ring 7. The waterway dispenser 8 switches among waterways of a plurality of water pipes in the effuser to achieve different flushing functions. In some embodiments, switching among waterways may allow the stepper motor 3 to open and close various water outlet dispensing ports 81 of the waterway dispenser 8. In some embodiments, the effuser 6 may include a plurality of water pipes arranged inside the effuser. Spouts and/or nozzles with different characteristics may be selected for each water pipe and a plurality of water pipes may be combined with the waterway dispenser 8 to provide different water flushing effects. This may result in a comfortable cleaning experience for users.

Figure 5:
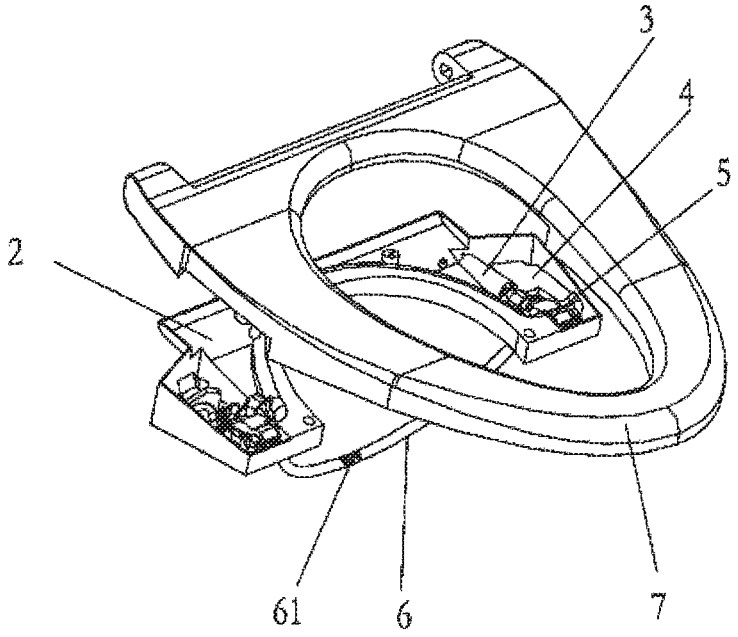
FIG. 5 is an illustration of one embodiment of the invention showing an exploded view of an effuser device with a seat ring.

As shown in FIGS. 3, 5, and 7, some embodiments of the base 2 may include two stepper motors 3 and two transmission mechanisms 5. One stepper motor 3 and one transmission mechanism 5 are arranged at one end of the base 2, the other stepper motor 3 and the other transmission mechanism 5 are arranged at the other end of the base 2. The effuser 6 is connected between the two transmission mechanisms 5 and can rotate about an axis between output ends of the two transmission mechanisms 5. The base mounting portion 21 of the base 2 is configured to house two drive transmission systems (i.e. two stepper motors 3 and two transmission mechanisms 5 are arranged such that one set is at each end of the base mounting portion 21 for rotating the effuser 6). The effuser 6 is connected to the two transmission mechanisms 5 at both ends of the base mounting portion 21. When driven by the transmission mechanisms 5, the effuser 6 can roll in and out in a rotating manner about the axis between output ends of the two transmission mechanisms 5. The effuser 6 may extend fanwise, or in an overturn manner, from the lower part of the base 2 to a task position below the seat ring 7. Effuser 6 retracts fanwise, or in an overturn manner, into the effuser resetting groove 22 below the base 2.

Figure 8:
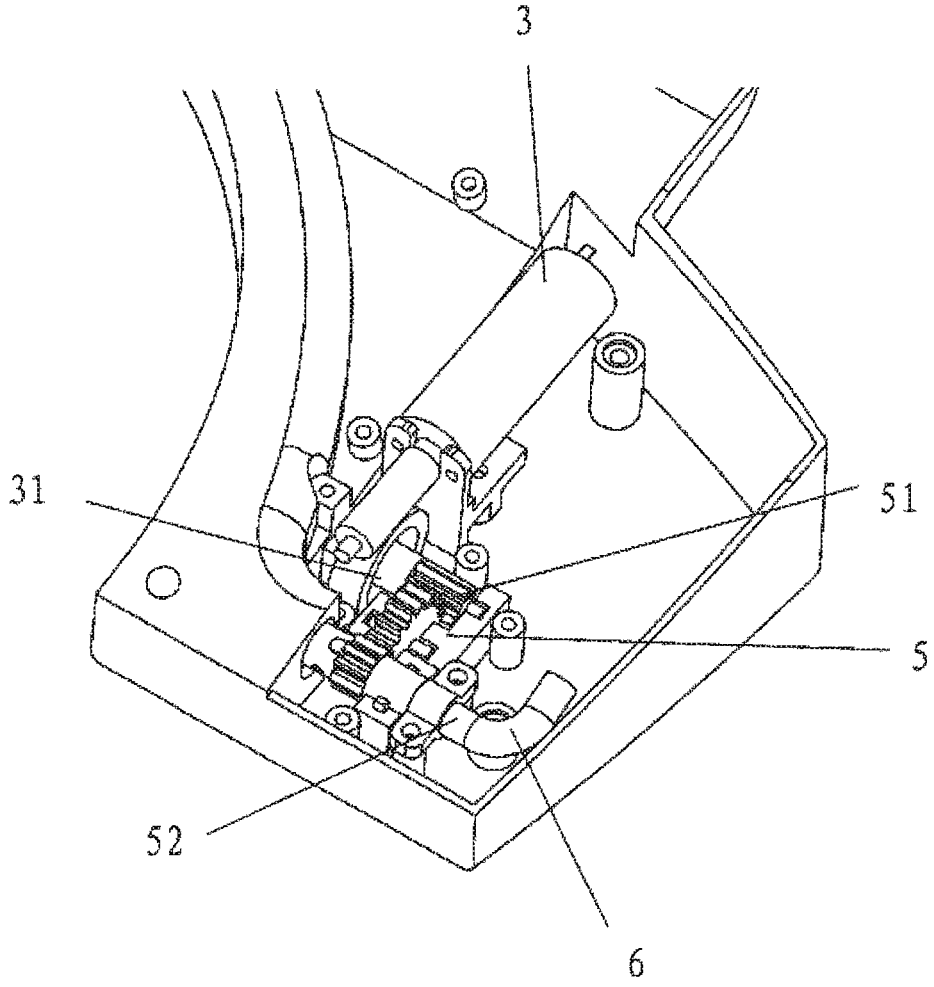
FIG. 8 is an internal view of one embodiment of the effuser device showing a stepper motor and a transmission mechanism.

In some preferred embodiments as shown in FIG. 8, the transmission mechanism 5 may be a gear train 51 engaged together for gearing down. An end of the effuser 6 is connected onto an output shaft of the gear train 51, and an input end of the gear train 51 is connected to the output end of the stepper motor 3 for torque transmission to rotate effuser 6. The input end of the gear train 51 matches a stepper motor output end 31. The drive circuit board 4 provides a forward/reverse rotation signal to the stepper motor 3. Stepper motor 3 then rotates forward or in reverse, depending on the signal received, to transmit torque to the input end of the gear train 51. Then the gear train 51 shifts gears down. The resulting torque, after gearing down, is transmitted to the effuser 6 via the output shaft 52 of the gear train 51. The effuser 6, when driven by the output shaft 52, rotates about an axis formed by the two output shafts 52. Effuser 6 may roll out/in fanwise in an overturn manner from the lower part of the base 2.

One embodiment of the effuser device only needs one effuser 6 with simple mounting. The length of the effuser 6 may be longer than that of an effuser of an ordinary pedestal pan device so that more water pipes and nozzles 61 can be arranged in the effuser 6. The nozzle 61 is positioned on a central axis, along the width direction of the seat ring, so that spraying water at an angle is unnecessary. This may save water resources. In some embodiments, combining a plurality of water pipes with a variety of nozzles may provide a diversified and more comfortable cleaning experience to users. In some embodiments, the effuser 6, the stepper motor 3, the drive circuit board 4, and the transmission mechanism 5 are all located in the base 2. This reduces the overall size of the device. Moreover, the effuser 6 can fan in and out when driven by the stepper motor 3 and the transmission mechanism 5.

Figure 9:
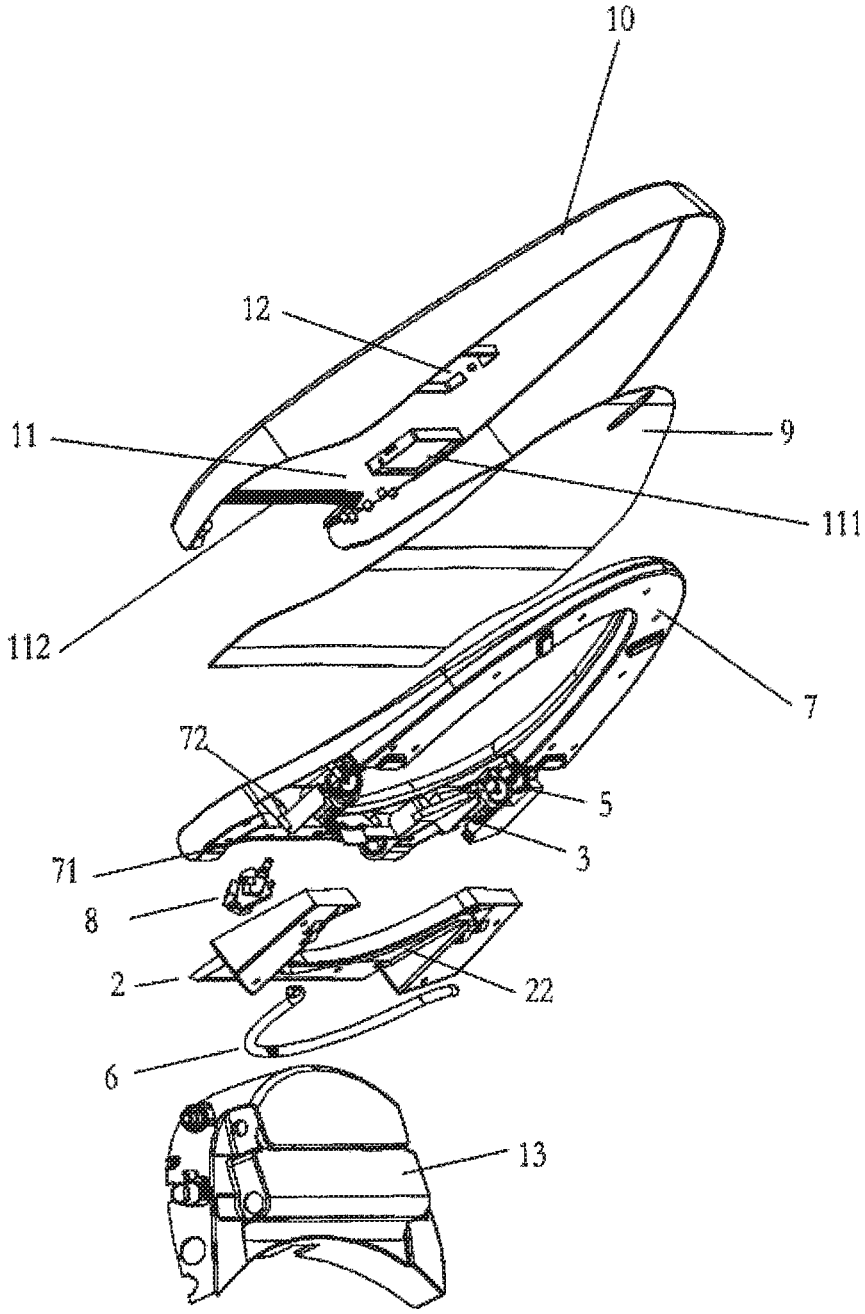
FIG. 9 is an exploded view of one embodiment of the invention.

As shown in FIG. 9, with reference to FIGS. 3-8, a pedestal pan according to an embodiment of the invention includes a cover board 10, a seat ring 7 and an effuser device 1 mounted in the seat ring 7. The effuser device 1 includes a base 2, a stepper motor 3, a transmission mechanism 5, and an effuser 6. The stepper motor 3 is mounted on the base 2. The transmission mechanism 5 is also mounted on the base 2 and connected with an output end of the stepper motor 3. The effuser 6 is connected with the transmission mechanism 5. The effuser 6 also includes an internal water pipe (not shown) and a nozzle 61 for spraying water from the water pipe. The base 2 is fixed below the seat ring 7. The transmission mechanism 5, when driven by the stepper motor 3, extends or retracts the effuser 6 in an overturn manner from a lower part of the base 2.

The effuser device 1 is arranged in the seat ring 7, thereby saving mounting space. As described above, the effuser device 1 includes a base 2, a stepper motor 3, a transmission mechanism 5, and an effuser 6. The effuser 6 can extend or retract fanwise in an overturn manner from the lower part of the base 2 when driven by the transmission mechanism 5. A main control unit 11 on the pedestal pan transmits a signal to a drive circuit board 4 which then transmits the signal to the stepper motor 3. The stepper motor 3 starts forward/reverse operation after receiving the signal. An output end of the transmission mechanism 5 transmits torque to the effuser 6. The effuser 6 can extend or retract fanwise in an overturn manner from the lower part of the base 2 when driven by the transmission mechanism 5 in response to the signal from main control unit 11. Since the effuser device 1 is arranged in the seat ring 7 and the base 2 is arranged below the seat ring 7, the effuser 6 may extend or retract fanwise in an overturn manner from a lower part of the seat ring 7 when driven by the transmission mechanism 5. As shown in FIG. 4, the effuser 6 may expand fanwise from the lower part of the seat ring 7 and stop below the seat ring 7. When a user activates the device, clean water will flow into the water pipe in the effuser 6 and then will be sprayed out from the nozzle 61. The water cleans a local part of the human body. When water stops spraying, the effuser can retract into the base 2 from the lower part of the seat ring 7 along the direction shown by the arrow in FIG. 4. For a pedestal pan according to an embodiment of the invention, the effuser device 1 may be located in the seat ring. This location may make more space for equipping the pedestal pan with other components. This may also allow a pedestal pan device to have a small thickness (e.g. thin profile) and a compact structure.

In some preferred embodiments, the main control unit 11 is arranged inside the cover board 10 and includes a main control panel 111 and a main control circuit 112. The main control panel 111 is connected with a controlled component via the main control circuit 112. Particularly, the main control panel 111 is connected with the drive circuit board 4 via the control circuit 112 to control the operation of the stepper motor 3. In some embodiments, the control panel 111 may be connected with other components to be controlled. Control panel 111 may control the operation of these other components. The control unit 11 is arranged in a main control panel mounting space 12 below the cover board 10. The control unit 11 may be arranged or positioned on the toilet cover in a distributed control manner, thereby reducing internal line arrangement and saving space.

A seat ring mounting portion 71 is also arranged below the seat ring 7. The effuser device 1 is mounted in the seat ring mounting portion 71. This configuration may provide more space for equipping the pedestal pan with other components, and save space at a rear part of the pedestal pan. In some embodiments, the overall thickness of the pedestal pan may be reduced to 80 mm. The cover board 10 and a cover board inner cover 9 are combined together to form a space for arranging components such as electric wires. The cover board 10, the cover board inner cover 9, the seat ring 7, and the effuser device 1 may be sequentially assembled on a toilet seat 13. This may result in a more compact structure and a thinner appearance.

In some embodiments, the base 2 may include an effuser resetting groove 22 as shown in FIGS. 6-7. The effuser resetting groove 22 receives the effuser 6 when the effuser 6 is retracted. When driven by the transmission mechanism 5 to retract fanwise, the effuser 6 retracts into the effuser resetting groove 22. The effuser 6 is located below a middle position of the seat ring 7 when extended in an overturn manner, and the effuser 6 is located in the effuser resetting groove 22 below the base 2 when retracted.

In some embodiments, the effuser 6 is an arc-shaped effuser. The nozzle 61 may be arranged on a central axis of the effuser 6. The effuser 6 is a whole effuser which may have a length longer than that of an ordinary effuser and a size larger than that of an ordinary effuser. In some embodiments, effuser 6 has a plurality of internal water pipes and a variety of nozzles 61. One water pipe corresponds to one spout/nozzle. Different water types, including different spray types or effects, can be achieved using different spouts/nozzles. This results in different spray cleaning effects for users. This may improve user comfort.

In some preferred embodiments, the nozzle 61 is located on a central axis along the depth of the seat ring 7. During rolling in and out, the nozzle 61 may be kept on this central axis of the seat ring 7 as illustrated in FIG. 4. (i.e. the nozzle 61 is always located on a central axis, centered along the width of the toilet and running front to back). This may allow the nozzle 61 to be adapted to the sitting posture of the human body, thereby better cleaning a local part of the human body.

In one embodiment, an instruction may be sent via a wireless remote control or control panel to the main control unit 11. The main control unit 11 transmits the instruction to the drive circuit board 4 and other control components. The drive circuit board 4 delivers the instruction to the stepper motor 3 which then operates after receiving the instruction. The stepper motor output end 31 transmits torque to the input end of the gear train 51. The resulting torque, after gear shifting via the gear train, is transmitted to the effuser 6 via the output shaft 52 of the gear train 51. Then, the effuser 6 rotates about an axis formed by the output shafts 52 of each gear train 51. The effuser 6 rolls out fanwise in an overturn manner from the lower part of the seat ring 7 to a task position below the middle position of the seat ring 7 according to the instruction of the user. Water pipes in the effuser 6 and corresponding spouts/nozzles are selected based on the waterway dispenser 8. The selected water types, which may include a particular spray type or effect, are sprayed out from the nozzle 61, which is on the central axis of the seat ring 7, to clean a local region of the human body. When the user finishes cleaning, a refraction instruction is sent via the wireless remote controller or control panel. The stepper motor 3 will operate in reverse, and the gear train 51 drives the effuser 6 to roll fanwise in an overturn manner from the lower part of the seat ring 7 into the effuser resetting groove 22 in the base 2. A pedestal pan according to one embodiment of the present invention may save space by mounting the effuser device 1 in the seat ring 7. This may allow for a more compact structure and a thinner appearance. The transmission mechanism 5 drives the effuser 6 to extend or retract fanwise from the lower part of the seat ring 7 to achieve the function of partially cleaning the human body. The pedestal pan is simple in structure and may provide a comfortable experience to users.

The above descriptions are only principles and embodiments of the present invention. It should be noted that those ordinary skilled in the art can further make several other variations based on the principles of the present invention and the variations are within the scope of the present invention.

What is claimed is:

1. An effuser device for a plumbing apparatus, comprising:

a base;

a first stepper motor;

a first transmission mechanism connected with an output end of the first stepper motor;

a second stepper motor;

a second transmission mechanism connected with an output end of the second stepper motor; and an effuser extending between and connected to each of the first and second transmission mechanisms, the effuser configured to spray water from an internal water pipe using a nozzle;

wherein the effuser is configured to extend and retract by rotating about an axis extending between the first transmission mechanism and the second transmission mechanism.

2. The effuser device of claim 1, wherein the effuser is configured to extend to an extended position beneath the user such that water is sprayed substantially perpendicular to a ground plane.

3. The effuser device of claim 1, wherein the effuser is configured to retract to a retracted position hidden beneath a portion of the plumbing apparatus.

4. The effuser device of claim 3, wherein the base has a lower surface defining an effuser resetting groove configured to receive the effuser in the retracted position.

5. The effuser device of claim 4, wherein the effuser is arc-shaped, having a radius corresponding to a radius of the base;

and wherein the effuser is configured to be hidden below the base while the effuser is in the retracted position.

6. The effuser device of claim 1, wherein the first stepper motor and the first transmission mechanism are positioned at a first end of the base, and the second stepper motor and the second transmission mechanism are positioned at an opposing second end of the base.

7. The effuser device of claim 1, wherein at least one of the first and second transmission mechanisms is a gear train configured to gear down an input from the corresponding first or second stepper motor, wherein an input end of the gear train matches the output end of the corresponding first or second stepper motor for torque transmission, and wherein an end of the effuser is connected to an output shaft of the gear train.

8. The effuser device of claim 1, further comprising a seat ring coupled to the base.

9. The effuser device of claim 8, further comprising:

a cover board coupled to the seat ring and housing a main control unit, the main control unit comprising a main control panel and a main control circuit configured to receive an instruction from the main control panel; and a drive circuit board housed in the base, the drive circuit board configured to receive the instruction from the main control circuit and to activate at least one of the first and second stepper motors.

10. The effuser device of claim 8, wherein the effuser is arc-shaped, having a radius corresponding to a radius of the seat ring; and wherein the effuser is configured to be hidden below the seat ring while the effuser is in a retracted position.

11. The effuser device of claim 1, wherein the first and second stepper motors and the first and second transmission mechanisms are housed within the base.

12. The effuser of claim 7, wherein each of the first and second transmission mechanisms includes an output shaft; and wherein the axis is extends through each of the output shafts.

13. The effuser device of claim 1, wherein the nozzle is centrally located on the effuser.

14. The effuser device of claim 1, further comprising a waterway dispenser fluidly coupled to the nozzle and configured to switch among a plurality of water pipes to achieve different flushing functions.

15. A method for operating an effuser of a plumbing apparatus, comprising:

generating torque with first and second stepper motors;

transferring torque from the first stepper motor to a first transmission mechanism and from the second stepper motor to a second transmission mechanism;

rotating the effuser about an axis extending between the first and second transmission mechanisms, using torque from each of the first and second transmission mechanisms; and spraying water from a nozzle on the effuser.

16. The method of claim 15, further comprising rotating the effuser about the axis to a retracted position such that the effuser is hidden beneath a portion of a seat of the plumbing apparatus.

17. The method of claim 15, further comprising receiving the effuser in an effuser resetting groove when the effuser is in a retracted position.

18. The method of claim 15, wherein the first transmission mechanism is disposed at an opposing end of the effuser from the second transmission mechanism.

19. The method of claim 15, further comprising:

receiving an instruction at a main control unit;

transmitting the instruction to a drive circuit board;

delivering the instruction from the drive circuit board to at least one of the first and second stepper motors; and activating at least one of the first and second stepper motors based on the instruction.

20. The method of claim 19, further comprising sending the instruction from a wireless remote control to the main control unit.

21. An effuser device for a plumbing apparatus, comprising:

a motor;

a transmission mechanism connected to an output end of the motor; and an effuser connected with the transmission mechanism and configured to spray water from an internal water pipe through a nozzle;

wherein the transmission mechanism is a gear train configured to gear down an input from the motor, wherein an input end of the gear train matches the output end of the motor for torque transmission, and wherein an end of the effuser is connected to an output shaft of the gear train;

wherein the output shaft defines an axis that extends across a basin of the plumbing apparatus; and wherein the effuser is configured to rotate around the axis between a retracted position and an extended position.

22. The effuser device of claim 20, wherein the motor is a stepper motor.

23. The effuser device of claim 20, further comprising a base having a lower surface defining an effuser resetting groove configured to receive the effuser in the retracted position.

24. The effuser device of claim 20, wherein the effuser defines an arc-like shape extending across the basin.

25. The effuser device of claim 20, further comprising a seat ring coupled to the base, wherein the motor and the transmission mechanism are housed within the base.

* * * * *